US008845398B2

(12) United States Patent
Chen

(10) Patent No.: US 8,845,398 B2
(45) Date of Patent: Sep. 30, 2014

(54) CHEMICAL MECHANICAL POLISHER AND POLISHING PAD COMPONENT THEREOF

(75) Inventor: Feng Chen, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 242 days.

(21) Appl. No.: 13/240,733

(22) Filed: Sep. 22, 2011

(65) Prior Publication Data

US 2012/0276825 A1 Nov. 1, 2012

(30) Foreign Application Priority Data

Apr. 29, 2011 (CN) ..... 2011 1 0110156

(51) Int. Cl.

| | |
|---|---|
| ***B24B 37/34*** | (2012.01) |
| ***B24B 37/22*** | (2012.01) |
| ***B24B 45/00*** | (2006.01) |
| ***B24D 13/20*** | (2006.01) |

(52) U.S. Cl.

CPC ..... *B24B 37/22* (2013.01); *B24B 37/34* (2013.01); *B24B 45/00* (2013.01); *B24D 13/20* (2013.01)

USPC ..... 451/490; 451/285; 451/287; 451/67; 451/72; 451/444

(58) Field of Classification Search

CPC ..... B24D 9/08; B24D 15/023

USPC ..... 451/494, 285, 286, 287, 288, 290, 550, 451/67, 72, 444

See application file for complete search history.

(56) References Cited

U.S. PATENT DOCUMENTS

| | | | | |
|---|---|---|---|---|
| 4,222,204 | A * | 9/1980 | Benner | 451/494 |
| 4,807,404 | A * | 2/1989 | Lewis | 451/494 |
| 4,941,245 | A * | 7/1990 | Yamashita et al. | 407/29.13 |
| 5,357,717 | A * | 10/1994 | Friel et al. | 451/494 |
| 6,033,293 | A * | 3/2000 | Crevasse et al. | 451/494 |
| 6,089,963 | A * | 7/2000 | Wiand et al. | 451/390 |
| 6,116,998 | A * | 9/2000 | Damgaard et al. | 451/490 |
| 6,217,425 | B1 * | 4/2001 | Shindou et al. | 451/259 |
| 6,224,474 | B1 * | 5/2001 | Vander Voort | 451/494 |
| 6,244,941 | B1 * | 6/2001 | Bowman et al. | 451/287 |
| 6,394,887 | B1 * | 5/2002 | Edinger | 451/494 |

(Continued)

OTHER PUBLICATIONS

Office Action from corresponding Chinese Patent Application No. 2011101101561, dated Feb. 26, 2014.

*Primary Examiner* — George Nguyen

(74) *Attorney, Agent, or Firm* — Koppel, Patrick, Heybl & Philpott; Michael J. Ram

(57) ABSTRACT

This disclosure is directed to a chemical mechanical polisher and a polishing pad component thereof. The chemical mechanical polisher comprises a polishing platen having a flat surface, and the polishing platen comprises: an electromagnet disposed under the flat surface and configured to fix a polishing pad base on the flat surface; and a switch configured to control the power-on and power-off of the electromagnet. The polishing pad component comprises a polishing pad base, and the polishing pad base is formed of a ferromagnetic material. The chemical mechanical polisher of this disclosure and the polishing pad component thereof can make polishing pad replacement easy, and can also save polishing pads and thus reduce the consumable cost of the chemical mechanical polishing.

10 Claims, 6 Drawing Sheets

(56) References Cited

U.S. PATENT DOCUMENTS

| | | | | |
|---|---|---|---|---|
| 6,958,001 | B2 * | 10/2005 | Chandrasekaran | 451/11 |
| 7,156,722 | B2 * | 1/2007 | Min et al. | 451/41 |
| 7,361,078 | B2 * | 4/2008 | Taylor | 451/340 |
| 7,377,836 | B1 * | 5/2008 | Molnar | 451/5 |
| 2002/0098785 | A1 * | 7/2002 | Doan et al. | 451/285 |
| 2002/0173248 | A1 | 11/2002 | Doan et al. | |
| 2004/0242126 | A1 * | 12/2004 | Takeuchi | 451/41 |
| 2007/0281485 | A1 * | 12/2007 | Torii | 438/692 |

* cited by examiner

CHEMICAL MECHANICAL POLISHER AND POLISHING PAD COMPONENT THEREOF

CROSS-REFERENCE TO RELATED APPLICATIONS

This application claims priority to Chinese Patent Application No. 201110110156.1, filed on Apr. 29, 2011 and entitled "Chemical Mechanical Polisher and Polishing Pad Component Thereof", which is incorporated herein by reference in its entirety.

BACKGROUND OF THE INVENTION

1. Field of the Invention

This disclosure relates to a field of semiconductor manufacturing apparatus, and in particular relates to a chemical mechanical polisher (CMP) and a polishing pad component thereof.

2. Description of the Related Art

Chemical mechanical polishing technology enables global planarization for very large scale integrated circuits, and has the advantages of high polishing speed, high flatness etc. Therefore, chemical mechanical polisher has become one of the most critical tools in the semiconductor manufacturing field.

FIGS. 1A-1B are a plan view and a section view illustrating a structure of a polishing platen of a conventional chemical mechanical polisher. As shown in FIG. 1A, the polishing platen 110 may be, for example, circular. As shown in FIG. 1B, the polishing platen 110 has a flat surface 115. In a working state, a polishing pad 130 is stuck on the flat surface 115 of the polishing platen 110. The polishing pad 130 may be a single-layered pad, or may comprise a polishing top pad 132 and a polishing bottom pad 134 beneath the polishing top pad 132.

FIG. 2 illustrates a structure of the conventional chemical mechanical polisher. As shown in FIG. 2, the chemical mechanical polisher comprises a polishing device 210. The polishing device 210 shown in FIG. 2 has three polishing platens which may be used to perform a chemical mechanical polishing process on three wafers at the same time. In addition, the chemical mechanical polisher may further comprise a post cleaning device 220. The post cleaning device 220 is used to perform a cleaning process, such as megasonic cleaning, brushing, drying etc., on a wafer subjected to the chemical mechanical polishing process.

As for a polishing platen, sometimes it is necessary to use different slurries to perform chemical mechanical polishing processes due to different requirements of polishing. When a slurry is replaced, the polishing pad needs to be replaced correspondingly so as to avoid unexpected chemical reactions between different slurries. For a conventional chemical mechanical polisher, since the polishing pad is stuck on the polishing platen, it is necessary to tear the stuck and used polishing pad off the polishing platen and stick a new polishing pad again on the polishing platen when the polishing pad is replaced. The inventor of the present invention has found that this causes the following problems. First, it is not easy to tear the stuck and used polishing pad off the polishing platen, which makes it hard to replace the polishing pad during a chemical mechanical polishing process. Second, the torn-off polishing pad is usually damaged and thus it has to be discarded, which causes great waste of polishing pads. That is, the consumable cost of the chemical mechanical polishing process is increased.

SUMMARY OF THE INVENTION

This disclosure is proposed in view of the above problems.

An object of one aspect of this disclosure is to provide a chemical mechanical polisher and a polishing pad component thereof which are easy for polishing pad replacement.

An object of another aspect of this disclosure is to provide a chemical mechanical polisher and a polishing pad component thereof which save polishing pads and thus reduce consumable cost.

According to one aspect of this disclosure, there is provided a chemical mechanical polisher, comprising a polishing platen having a flat surface, wherein the polishing platen comprises: an electromagnet disposed under the flat surface and configured to fix a polishing pad base on the flat surface; and a switch configured to control the power-on and power-off of the electromagnet.

Preferably, the electromagnet is selected from a horseshoe-shaped electromagnet, a bar-shaped electromagnet and a ring-shaped electromagnet.

Preferably, the number of the electromagnet is more than one.

Preferably, the electromagnets are disposed under the flat surface uniformly.

Preferably, convex parts are disposed on the flat surface of the polishing platen, the convex parts being configured to be engaged with concave parts on a surface of the polishing pad base to be in contact with the flat surface of the polishing platen; or concave parts are disposed on the flat surface of the polishing platen, the concave parts being configured to be engaged with convex parts on a surface of the polishing pad base to be in contact with the flat surface of the polishing platen.

Preferably, the flat surface of the polishing platen and the polishing pad base are formed of the same material and have the same flatness.

Preferably, the chemical mechanical polisher further comprises a storage tank configured to store the polishing pad base on which a polishing pad is stuck.

Preferably, the storage tank comprises: a deionized water inlet disposed at an upper part of the storage tank; and a deionized water outlet disposed at a lower part of the storage tank.

Preferably, the chemical mechanical polisher further comprises the polishing pad base.

Preferably, the polishing pad base is formed of a ferromagnetic material.

Preferably, the ferromagnetic material is selected from iron, cobalt, nickel and alloys thereof According to another aspect of this disclosure, there is provided a polishing pad component used for a chemical mechanical polisher, the polishing pad component comprising a polishing pad base formed of a ferromagnetic material.

Preferably, the polishing pad component further comprises a polishing pad stuck on the polishing pad base.

Preferably, the polishing pad comprises a polishing top pad and a polishing bottom pad beneath the polishing top pad.

Preferably, the ferromagnetic material is selected from iron, cobalt, nickel and alloys thereof.

Preferably, concave parts are disposed on a surface of the polishing pad base to be in contact with a flat surface of a polishing platen, the concave parts being configured to be engaged with convex parts on the flat surface of the polishing platen; or convex parts are disposed on a surface of the polishing pad base to be in contact with a flat surface of a polishing platen, the convex parts being configured to be engaged with concave parts on the flat surface of the polishing platen.

Preferably, a flat surface of a polishing platen and the polishing pad base are formed of the same material and have the same flatness.

According to each of the above aspects of this disclosure, the chemical mechanical polisher of this disclosure and the polishing pad component thereof are easy for polishing pad replacement, and the chemical mechanical polisher of this disclosure and the polishing pad component thereof can also save polishing pads and thus reduce consumable cost.

BRIEF DESCRIPTION OF THE DRAWINGS

The accompanying drawings, which are incorporated in and constitute a part of the specification, illustrate embodiments of this disclosure and, together with the description, serve to explain the principles of this disclosure.

It is to be noted that, in the accompanying drawings, for convenience of description, the sizes of respective components may not be drawn based on actual scales.

FIGS. 1A-1B illustrate a structure of a polishing platen of a conventional chemical mechanical polisher, wherein FIG. 1A is a plan view, and FIG. 1B is a section view (taken along the dotted line in FIG. 1A) illustrating the case that a polishing pad is stuck on the polishing platen.

FIGS. 3A-3C illustrate a structure of a polishing platen of a chemical mechanical polisher of this disclosure, wherein FIG. 3A is a plan view (also illustrating an electromagnet inside the polishing platen), FIG. 3B is a section view (taken along the dotted line in FIG. 3A) illustrating the case that a polishing pad base (a polishing pad is stuck on the polishing pad base) is fixed on the polishing platen, and FIG. 3C is a section view (taken along the dotted line in FIG. 3A) illustrating the case that the polishing pad base (a polishing pad is stuck on the polishing pad base) is removed from the polishing platen.

The objects, features and advantages of this disclosure will become apparent from the following detailed description of exemplary embodiments with reference to the accompanying drawings.

DESCRIPTION OF THE EMBODIMENTS

Exemplary embodiments of this disclosure will be described in detail below with reference to the accompanying drawings. It shall be noted that the following description is merely illustrative in nature. The components and steps set forth in the embodiments do not limit the scope of this disclosure unless it is otherwise specifically stated. In addition, techniques, methods and devices known by persons skilled in the art may not be discussed in detail, but are intended to be a part of the specification where appropriate.

Figure 3A:
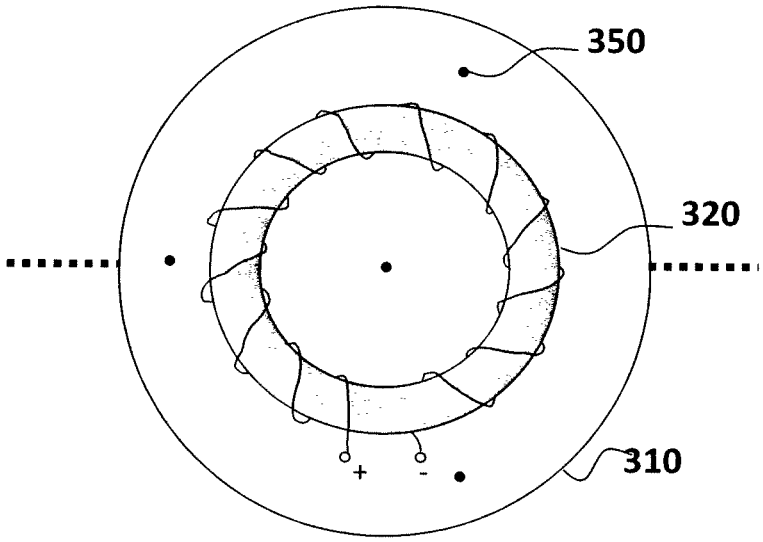
Figure 3B:
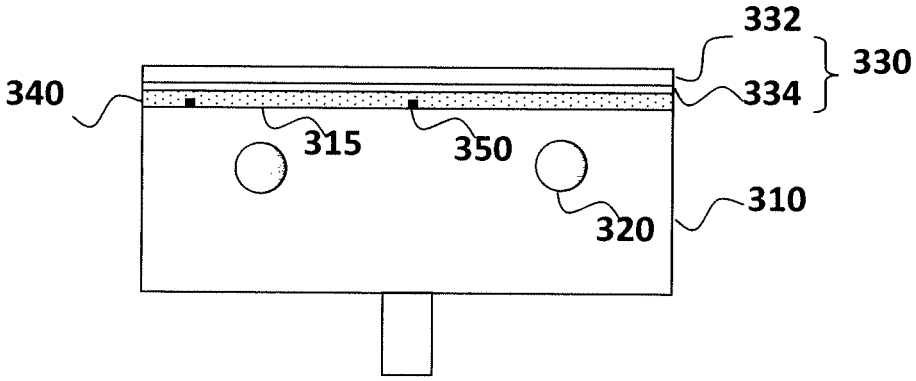
Figure 3C:
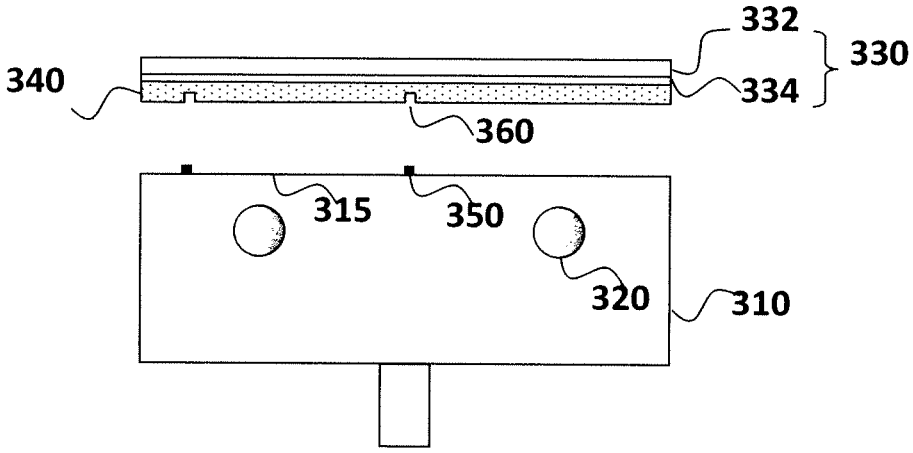

FIGS. 3A-3C illustrate a structure of a polishing platen of a chemical mechanical polisher of this disclosure. Referring to FIG. 3B, the polishing platen 310 of the chemical mechanical polisher of this disclosure has a flat surface 315. The flatness requirement for the flat surface 315 may be consistent with that for a conventional chemical mechanical polisher, for example. However, unlike the conventional chemical mechanical polisher shown in FIGS. 1A-1B, the polishing platen 310 of this disclosure comprises an electromagnet 320 disposed under the flat surface 315 of the polishing platen 310 and a switch (not shown) configured to control the power-on and power-off of the electromagnet 320. The electromagnet 320 is known to persons skilled in the art, and may be composed of, for example, a core and a coil (for purpose of convenience, the coil of the electromagnet is not shown in FIGS. 3B-3C). When the switch is turned on so that the electromagnet 320 is in an on state, a current flows in the coil of the electromagnet 320, thereby a magnetic field is generated; when the switch is turned off so that the electromagnet 320 is in an off state, the current in the coil of the electromagnet 320 stops flowing, thereby the magnetic field is no longer generated. As will be described later, the magnetic field generated by the electromagnet 320 is used to fix a polishing pad base on the flat surface 315 of the polishing platen 310, thereby a polishing pad on the polishing pad base is fixed on the flat surface 315 of the polishing platen 310.

Figure 1A:
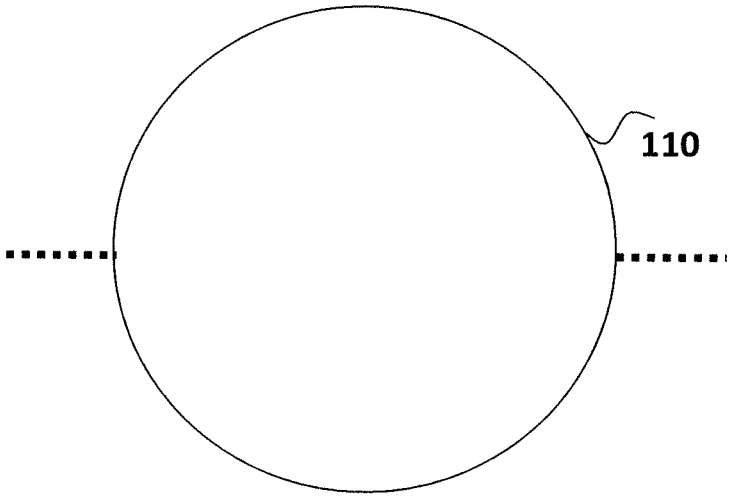
FIG. 1A Prior Art
Figure 1B:
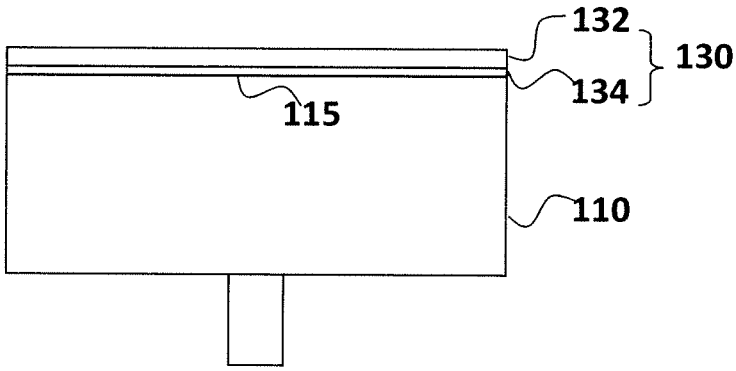
FIG. 1B Prior Art

In the conventional chemical mechanical polisher, in a working state, the polishing pad 130 is directly stuck on the flat surface 115 of the polishing platen 110 (referring to FIG. 1B). In comparison to this, in this disclosure, in a working state, the polishing pad 330 is stuck on the polishing pad base 340, and the polishing pad base 340 is fixed on the flat surface 315 of the polishing platen 310 (referring to FIG. 3B). The polishing pad 330 may be a single-layered pad, or may comprise a polishing top pad 332 and a polishing bottom pad 334 beneath the polishing top pad 332 as shown in FIGS. 3B-3C so as to improve polishing effect. The polishing pad 330 may also be a pad having three or more layers. The polishing pad base 340 of this disclosure is formed of a ferromagnetic material, and the ferromagnetic material may be selected from iron, cobalt, nickel and alloys thereof, for example. Therefore, when the switch of the electromagnet 320 is turned on, the electromagnet 320 generates a magnetic field, thereby the polishing pad base 340 on which the polishing pad 330 is stuck can be fixed on the flat surface 315 of the polishing platen 310 by magnetic force (referring to FIG. 3B) so as to perform a chemical mechanical polishing process. On the other hand, when the switch of the electromagnet 320 is turned off, the electromagnet 320 no longer generates the magnetic field, thereby the polishing pad base 340 on which the polishing pad 330 is stuck is no longer fixed on the flat surface 315 of the polishing platen 310 by magnetic force, thus the polishing pad base 340 on which the polishing pad 330 is stuck can be removed from the polishing platen 310 easily (referring to FIG. 3C).

As can be seen from the above, in the chemical mechanical polisher of this disclosure, the polishing pad base on which the polishing pad is stuck is replaced by switching the switch of the electromagnet so as to replace the polishing pad. In comparison to this, in the conventional chemical mechanical polisher, the polishing pad is replaced by tearing the stuck and used polishing pad off the polishing platen. Apparently, polishing pad replacement can be more easily carried out for the chemical mechanical polisher of this disclosure, which enables to remarkably improve the efficiency of the chemical mechanical polishing process.

In order to make the magnetic force, which is applied on the polishing pad base 340 by the electromagnet 320 of the polishing platen 310 during the polishing process, strong enough and uniform enough, the configuration of the electromagnet 320 may be designed appropriately. The electromagnet 320 shown in FIGS. 3A-3C is a ring-shaped electromagnet (which is shown more clearly in FIG. 3A). However, the type of the electromagnet 320 is not limited particularly, and it may also be, for example, a horseshoe-shaped electromagnet, a bar-shaped electromagnet etc. In addition, there is one electromagnet 320 shown in FIGS. 3A-3C (which is shown more clearly in FIG. 3A; and the two portions of the electromagnet shown in FIGS. 3B-3C actually belong to the same ring-shaped electromagnet). However, the number of the electromagnet 320 is not limited particularly, and it may also be, for example, more than one. When the number of the electromagnet is more than one, the electromagnets are preferably disposed under the flat surface 315 uniformly. The configuration of the electromagnet (including the type, number etc.) may be any desired configuration as long as the magnetic force applied on the polishing pad base by the electromagnet of the polishing platen during the polishing process can be made strong enough and uniform enough. For example, it is possible to employ four uniformly disposed horseshoe-shaped electromagnets, wherein one horseshoe-shaped electromagnet is disposed at the center and three horseshoe-shaped electromagnets are disposed uniformly at the periphery.

Furthermore, in order to fix a position of the polishing pad base 340 on the flat surface 315 of the polishing platen 310, a polishing pad base fixer may be provided. The polishing pad base fixer may comprise convex parts 350 disposed on the flat surface 315 of the polishing platen 310 and concave parts 360 on a surface of the polishing pad base 340 to be in contact with the flat surface 315 of the polishing platen 310 (referring to FIG. 3C). The convex parts 350 and the concave parts 360 are configured to be engaged with each other. Alternatively, the polishing pad base fixer may also comprise concave parts disposed on the flat surface 315 of the polishing platen 310 and convex parts on the surface of the polishing pad base 340 to be in contact with the flat surface 315 of the polishing platen 310. The shape and number of the convex part and concave part are not limited particularly. When the number of the convex part and concave part is more than one, the convex parts and concave parts are preferably uniformly disposed on the flat surface of the polishing platen and the surface of the polishing pad base to be in contact with the flat surface of the polishing platen. As an example, four convex parts 350 are shown in FIG. 3A, wherein one convex part 350 is disposed at the center of the circular flat surface 315, and three convex parts 350 are uniformly disposed at the periphery of the circular flat surface 315.

In addition, in order to fix the polishing pad base 340 on the flat surface 315 of the polishing platen 310 better during a polishing process, the flat surface 315 of the polishing platen 310 and the polishing pad base 340 are preferably formed of the same material and have the same flatness, but are not limited thereto.

In addition, in order to prevent the polishing pad base 340 from being corroded by slurries or the like during a polishing process, the polishing pad base 340 may have, for example, an antirust coating on a part or all of the surface, or the polishing pad base 340 may be formed of, for example, an antirust ferromagnetic material (such as stainless steel).

Figure 4:
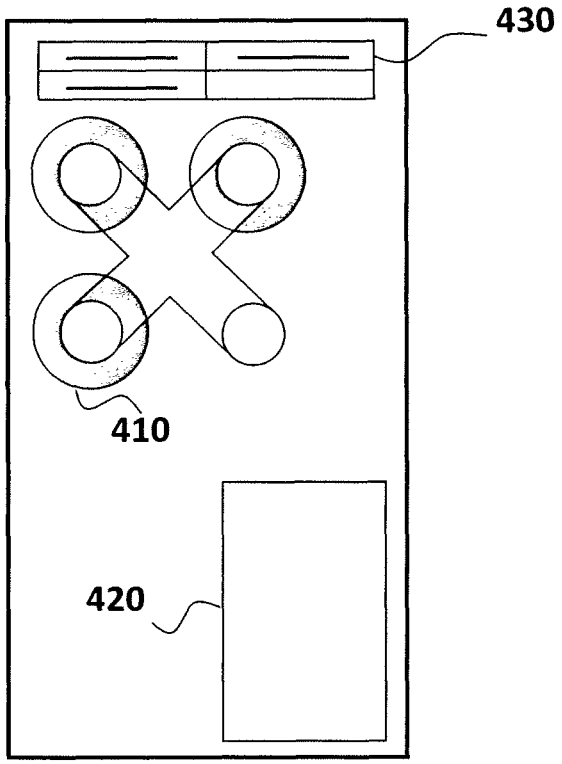
FIG. 4 is a schematic diagram illustrating a structure of the chemical mechanical polisher of this disclosure.

FIG. 4 is a schematic diagram illustrating a structure of the chemical mechanical polisher of this disclosure. As shown in FIG. 4, similar to the conventional chemical mechanical polisher, the chemical mechanical polisher of this disclosure comprises a polishing device 410. As an example, the polishing device 410 in FIG. 4 has three polishing platens which may be used to perform a chemical mechanical polishing process on three wafers at the same time; however, the number of the polishing platens is not limited thereto. Optionally, the chemical mechanical polisher of this disclosure may further comprise a post cleaning device 420. The post cleaning device 420 is used to perform a cleaning process, such as megasonic cleaning, brushing, drying etc., on a wafer subjected to the chemical mechanical polishing process. As can be seen by comparing FIGS. 2 and 4, unlike the conventional chemical mechanical polisher, the chemical mechanical polisher of this disclosure further comprises storage tanks 430 used to store the polishing pad base on which the polishing pad is stuck. As an example, four storage tanks 430 are shown in FIG. 4, wherein the polishing pad bases on which the polishing pads are stuck are stored in three storage tanks; however, the number of the storage tanks 430 is not limited particularly, and it may be, for example, one or more.

Figure 5:
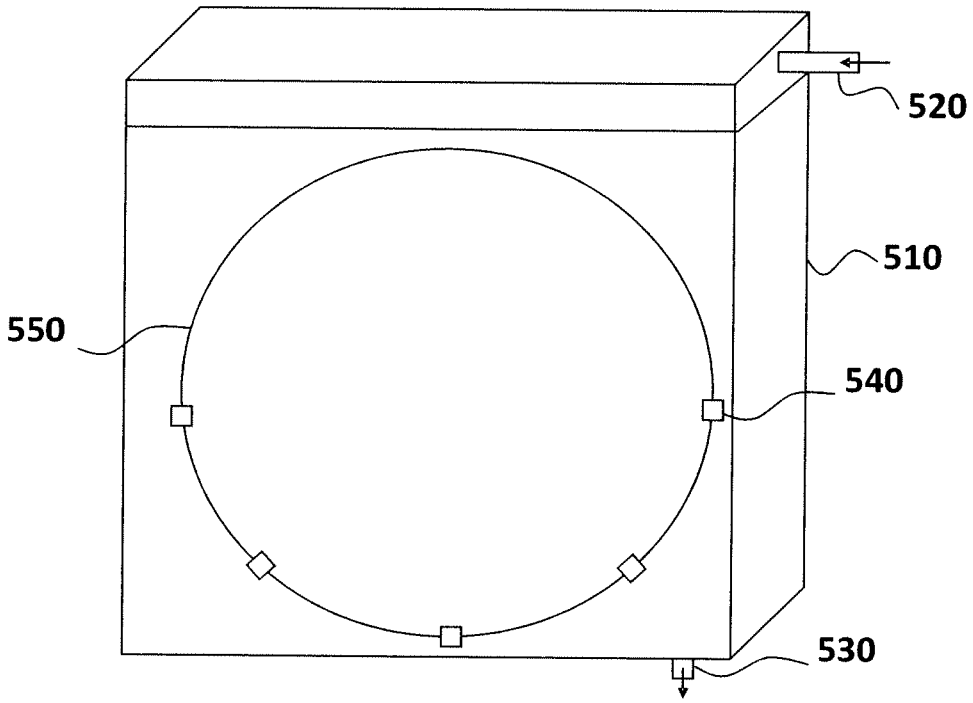
FIG. 5 is a schematic diagram illustrating a structure of a storage tank of the chemical mechanical polisher of this disclosure.

FIG. 5 is a schematic diagram illustrating a structure of the storage tank of the chemical mechanical polisher of this disclosure. As shown in FIG. 5, the storage tank comprises a case 510, a deionized water inlet 520 disposed at an upper part of the storage tank, a deionized water outlet 530 disposed at a lower part of the storage tank and holders 540 disposed inside the storage tank. The shape of the case 510 is not limited particularly, and it may be, for example, a rectangular parallelepiped etc. The deionized water inlet 520 and the deionized water outlet 530 can control the presence and absence of deionized water as well as the amount of deionized water inside the storage tank. When a polishing pad base on which a polishing pad is stuck is stored inside the storage tank, the storage tank contains deionized water therein so as to keep the polishing pad wet. The holders 540 are used to hold the polishing pad base 550 on which the polishing pad is stuck. The number and arrangement of the holders 540 are not limited to the case shown in FIG. 5, and it works as long as the holders 540 can hold the polishing pad base 550 on which the polishing pad is stuck well.

During a chemical mechanical polishing process, when a first slurry is to be replaced by a second slurry, it is necessary to remove from the polishing platen a polishing pad base on which a polishing pad that has used the first slurry for polishing is stuck, and fix again on the polishing platen another polishing pad base on which a polishing pad that will use the second slurry for polishing is stuck. At this time, the removed polishing pad base, on which the polishing pad that has used the first slurry for polishing is stuck, may be stored in the storage tank, and the deionized water inlet 520 and the deionized water outlet 530 can be controlled to keep the polishing pad that has used the first slurry for polishing wet so as to prepare for the next polishing using the first slurry.

In the chemical mechanical polishing process of this disclosure, the polishing pad base on which the polishing pad is stuck is replaced by switching the switch of the electromagnet so as to replace the polishing pad, which not only can make polishing pad replacement easier as described earlier, but also renders the polishing pad undamaged at the time of replacement. Moreover, the replaced polishing pad base on which the polishing pad is stuck may be stored in a storage tank, and the polishing pad is kept wet by using deionized water so as to prepare to be used for the next polishing using the same slurry. As can be seen from the above, this disclosure enables the polishing pad to be reused. In comparison to this, in the conventional chemical mechanical polishing process, the polishing pad removed from the polishing platen by tearing is usually damaged, and thus has to be discarded. Apparently, the chemical mechanical polisher of this disclosure can save polishing pads, and thus can reduce the consumable cost of the chemical mechanical polishing process remarkably.

Incidentally, as an embodiment of the chemical mechanical polisher of this disclosure, the chemical mechanical polisher may not comprise the polishing pad base. In this case, a polishing pad component as a consumable of the chemical mechanical polisher may comprise the polishing pad base, and users may stick an additionally obtained polishing pad on the polishing pad base for polishing. Alternatively, in this case, the polishing pad component as a consumable of the chemical mechanical polisher may comprise the polishing pad base and the polishing pad stuck on the polishing pad base.

As another embodiment of the chemical mechanical polisher of this disclosure, the chemical mechanical polisher may comprise the polishing pad base. In this case, users may stick a polishing pad as a consumable of the chemical mechanical polisher on the polishing pad base for polishing.

A method of operating the chemical mechanical polisher is briefly described below.

Figure 2:
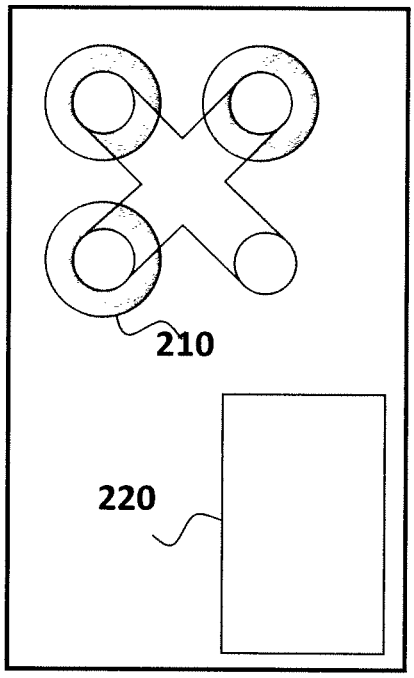
FIG. 2 Prior Art
FIG. 2 is a schematic diagram illustrating a structure of the conventional chemical mechanical polisher.

As for the conventional chemical mechanical polisher as shown in FIGS. 1A-1B and 2, its operating method is described as follows.

First, a polishing pad is stuck on the polishing platen, and the chemical mechanical polishing is carried out by using a first slurry.

When the slurry needs to be replaced, the used polishing pad is removed from the polishing platen by tearing, and the used polishing pad that is damaged is discarded.

Then, a new polishing pad is stuck on the polishing platen, and the chemical mechanical polishing is carried out by using a second slurry.

In comparison to this, as for the chemical mechanical polisher of this disclosure as shown in FIGS. 3A-3C and 4-5, its operating method is described as follows.

First, the switch of the electromagnet is turned on to fix the polishing pad base on which a polishing pad is stuck on the polishing platen by magnetic force, and the chemical mechanical polishing is carried out by using a first slurry. If the chemical mechanical polisher is provided with the polishing pad base fixer comprising the convex parts and the concave parts, the switch of the electromagnet can be turned on after the convex parts and the concave parts are engaged with each other so as to fix the position of the polishing pad base on the polishing platen.

When the slurry needs to be replaced, the switch of the electromagnet is turned off so that the polishing pad base on which the used polishing pad is stuck can be easily removed from the polishing platen. The used polishing pad is not damaged. Optionally, after being rinsed by using deionized water, the removed polishing pad base on which the used polishing pad is stuck can be stored in the storage tank, and the used polishing pad is kept wet by using deionized water so as to prepare to be used for the next polishing using the first slurry (i.e., reuse).

Then, the switch of the electromagnet is turned on to fix another polishing pad base, on which a polishing pad that will use a second slurry for polishing is stuck, on the polishing platen by magnetic force, and the chemical mechanical polishing is carried out by using the second slurry. Likewise, if the chemical mechanical polisher is provided with the polishing pad base fixer comprising the convex parts and the concave parts, the switch of the electromagnet can be turned on after the convex parts and the concave parts are engaged with each other so as to fix the position of the polishing pad base on the polishing platen.

Persons skilled in the art readily understand from the above teaching that, as compared with the conventional chemical mechanical polisher, the chemical mechanical polisher of this disclosure and the polishing pad component thereof can make polishing pad replacement easy, and the chemical mechanical polisher of this disclosure and the polishing pad component thereof can also save polishing pads and thus reduce the consumable cost of the chemical mechanical polishing.

While this disclosure has been described with reference to exemplary embodiments, it shall be understood that this disclosure is not limited to the described exemplary embodiments. It is obvious to persons skilled in the art that the above exemplary embodiments may be modified without deviating from the scope and spirit of this disclosure. The scope of the appended claims is to be accorded with the broadest interpretation so as to encompass all such modifications and equivalent structures and functions.

What is claimed is:

1. A chemical mechanical polisher, comprising a polishing platen having a flat surface, wherein the polishing platen comprises:

an electromagnet disposed under the flat surface and configured to hold a polishing pad base on the flat surface;

a switch configured to control the power-on and power-off of the electromagnet; and a storage tank configured to store the polishing pad base with a polishing pad thereon, the polishing pad having a size greater than that of a wafer to be polished, the polishing pad base with the polishing pad thereon being held in the storage tank by holders.

2. The chemical mechanical polisher of claim 1, wherein the electromagnet is selected from a horseshoe-shaped electromagnet, a bar-shaped electromagnet and a ring-shaped electromagnet.

3. The chemical mechanical polisher of claim 1, wherein the number of the electromagnet is more than one.

4. The chemical mechanical polisher of claim 3, wherein the electromagnets are disposed under the flat surface uniformly.

5. The chemical mechanical polisher of claim 1, wherein convex parts are disposed on the flat surface of the polishing platen, the convex parts being configured to be engaged with concave parts on a surface of the polishing pad base to be in contact with the flat surface of the polishing platen; or wherein concave parts are disposed on the flat surface of the polishing platen, the concave parts being configured to be engaged with convex parts on a surface of the polishing pad base to be in contact with the flat surface of the polishing platen.

6. The chemical mechanical polisher of claim 1, wherein the flat surface of the polishing platen and the polishing pad base are formed of the same material and have the same flatness.

7. The chemical mechanical polisher of claim 1, wherein the storage tank comprises:

a deionized water inlet disposed at an upper part of the storage tank; and a deionized water outlet disposed at a lower part of the storage tank.

8. The chemical mechanical polisher of claim 1, further comprising the polishing pad base.

9. The chemical mechanical polisher of claim 8, wherein the polishing pad base is formed of a ferromagnetic material.

10. The chemical mechanical polisher of claim 9, wherein the ferromagnetic material is selected from iron, cobalt, nickel and alloys thereof.

* * * * *